US009976268B2

(12) United States Patent
Giletta

(10) Patent No.: US 9,976,268 B2
(45) Date of Patent: May 22, 2018

(54) BLADE FOR REMOVING SNOW

(71) Applicant: Giletta S.p.A., Revello (IT)

(72) Inventor: Enzo Giletta, Revello (IT)

(73) Assignee: GILETTA S.P.A., Revello (IT)

( * ) Notice: Subject to any disclaimer, the term of this patent is extended or adjusted under 35 U.S.C. 154(b) by 0 days. days.

(21) Appl. No.: 15/386,084

(22) Filed: Dec. 21, 2016

(65) Prior Publication Data

US 2017/0101757 A1 Apr. 13, 2017

Related U.S. Application Data

(63) Continuation of application No. 13/522,354, filed on Jul. 16, 2012, which is a continuation of application No. PCT/IB2011/000089, filed on Jan. 21, 2011.

(30) Foreign Application Priority Data

Jan. 22, 2010 (IT) ..... TO2010A0039

(51) Int. Cl.
*E01H 5/06* (2006.01)
*E01H 10/00* (2006.01)
*E01H 5/00* (2006.01)

(52) U.S. Cl.
CPC ..... *E01H 10/007* (2013.01); *E01H 5/00* (2013.01); *E01H 5/061* (2013.01); *E01H 5/066* (2013.01)

(58) Field of Classification Search
CPC ..... E01H 5/00; E01H 5/061; E01H 5/066; E01H 10/007
USPC ..... 37/227, 233, 266, 407
See application file for complete search history.

(56) References Cited

U.S. PATENT DOCUMENTS 1,629,160 A * 5/1927 Heermance ..... E01H 5/10 126/271.1
1,747,258 A * 2/1930 O'Neil ..... A01B 1/02 111/7.1
2,222,437 A * 11/1940 Lykken ..... E01H 5/076 37/195
2,936,537 A * 5/1960 Bain ..... E01H 5/076 37/202
3,014,289 A * 12/1961 Torrey ..... E01H 5/062 172/705
3,456,368 A * 7/1969 Jacques ..... E01H 1/108 126/343.5 R
3,465,456 A * 9/1969 Meyer ..... E01H 1/105 15/245
3,685,592 A * 8/1972 Frisbee ..... E02F 3/815 172/755
4,068,725 A * 1/1978 Watson ..... A01B 17/00 172/1
4,142,590 A * 3/1979 Watson ..... A01B 17/00 172/1

(Continued)

*Primary Examiner* — Thomas B Will
*Assistant Examiner* — Joan D Misa
(74) *Attorney, Agent, or Firm* — Dorsey & Whitney LLP

(57) ABSTRACT

A blade for removing snow from a road surface comprising a shield oriented to deflect the snow, a cutting edge carried on the bottom part of the shield and adjacent to a road surface when in use, and at least one fluid circuit comprising a nozzle for spreading a de-icing liquid, wherein at least the nozzle is carried by the shield or by the cutting edge to spread at least part of the de-icing liquid on the snow in an area in front of and/or beneath said cutting edge while said cutting edge compresses a layer of snow that remains on the road surface during its passage.

16 Claims, 2 Drawing Sheets

(56) References Cited

U.S. PATENT DOCUMENTS 4,347,677 A * 9/1982 Kuper ..... E01H 5/061 37/233
4,571,861 A * 2/1986 Klever ..... E01H 5/066 111/34
4,709,492 A * 12/1987 Watson ..... E01H 5/02 172/727
5,075,987 A * 12/1991 Akiyama ..... E01H 5/066 37/220
5,140,763 A * 8/1992 Nichols, IV ..... E01H 5/062 37/233
5,515,623 A * 5/1996 Weeks ..... E01H 10/007 239/159
5,603,172 A * 2/1997 Maher ..... E01H 5/062 172/794
5,720,122 A * 2/1998 McLellan ..... E01H 5/068 37/232
7,467,485 B2 * 12/2008 Lachance ..... E01H 5/062 172/264
7,543,401 B2 * 6/2009 Hughes ..... E01H 5/062 37/232
7,716,857 B2 * 5/2010 Nagamatsu ..... A01B 1/02 37/241
7,765,726 B2 * 8/2010 Kuper ..... E01H 5/061 172/701.3
7,784,200 B2 * 8/2010 Nagamatsu ..... A01G 1/125 37/241
7,823,303 B2 * 11/2010 Nagamatsu ..... A01G 1/125 37/241
8,403,595 B2 * 3/2013 Hall ..... E01C 23/088 299/39.1
2005/0120594 A1 * 6/2005 Hollinrake ..... E01H 5/062 37/266
2008/0244935 A1 * 10/2008 Crimmins ..... E01H 5/066 37/266

* cited by examiner

BLADE FOR REMOVING SNOW

CROSS REFERENCE TO RELATED APPLICATIONS

This application is a continuation of pending U.S. patent application Ser. No. 13/522,354, filed Jul. 16, 2012, entitled "Blade for Removing Snow," which claims the benefit of earlier-filed Patent Cooperation Treaty (PCT) Patent Application Serial No. PCT/IB2011/000089, filed Jan. 21, 2011, which, in turn, claims the benefit from Italian Patent Application No. TO2010A000039, filed Jan. 22, 2010, the contents of each are incorporated herein by reference.

TECHNICAL FIELD

The present invention relates to a blade for removing snow or ice from the road.

BACKGROUND ART

A blade is fitted to a vehicle for clearing snow or slushy mixtures of snow and ice from a road.

While the vehicle is moving, the blade is raised and held at a distance from the road surface to prevent it from being damaged. In this way, some of the snow is not deflected as it remains between the blade and the road surface and is thus left on the road surface. The snow that is left on the road surface may be compressed by passing vehicles and turn into ice, thus creating hazardous conditions for traffic.

An object of the present invention is to provide a more efficient blade for removing snow or ice from a road.

SUMMARY OF THE PRESENT INVENTION

The present invention is directed to a blade for removing snow from a road surface, where the blade includes a shield oriented to deflect the snow, a cutting edge carried on the bottom part of the shield and adjacent to a road surface when in use, and at least one fluid circuit having a nozzle for spreading a de-icing liquid, where at least the nozzle is carried by the shield or by the cutting edge to spread at least part of the de-icing liquid on the snow in an area in front of and/or beneath said cutting edge while said cutting edge compresses a layer of snow that remains on the road surface during its passage.

BRIEF DESCRIPTION OF THE DRAWINGS

The present invention will now be described with reference to the accompanying Drawings, illustrating some non-limiting embodiments thereof, in which.

DETAILED DESCRIPTION OF THE PRESENT INVENTION

The following detailed description is presented to enable any person skilled in the art to make and use the invention. For purposes of explanation, specific nomenclature is set forth to provide a thorough understanding of the present invention. However, it will be apparent to one skilled in the art that these specific details are not required to practice the invention. Descriptions of specific applications are provided only as representative examples. Various modifications to the preferred embodiments will be readily apparent to one skilled in the art, and the general principles defined herein may be applied to other embodiments and applications without departing from the scope of the invention. The present invention is not intended to be limited to the embodiments shown, but is to be accorded the widest possible scope consistent with the principles and features disclosed herein.

Figure 1:
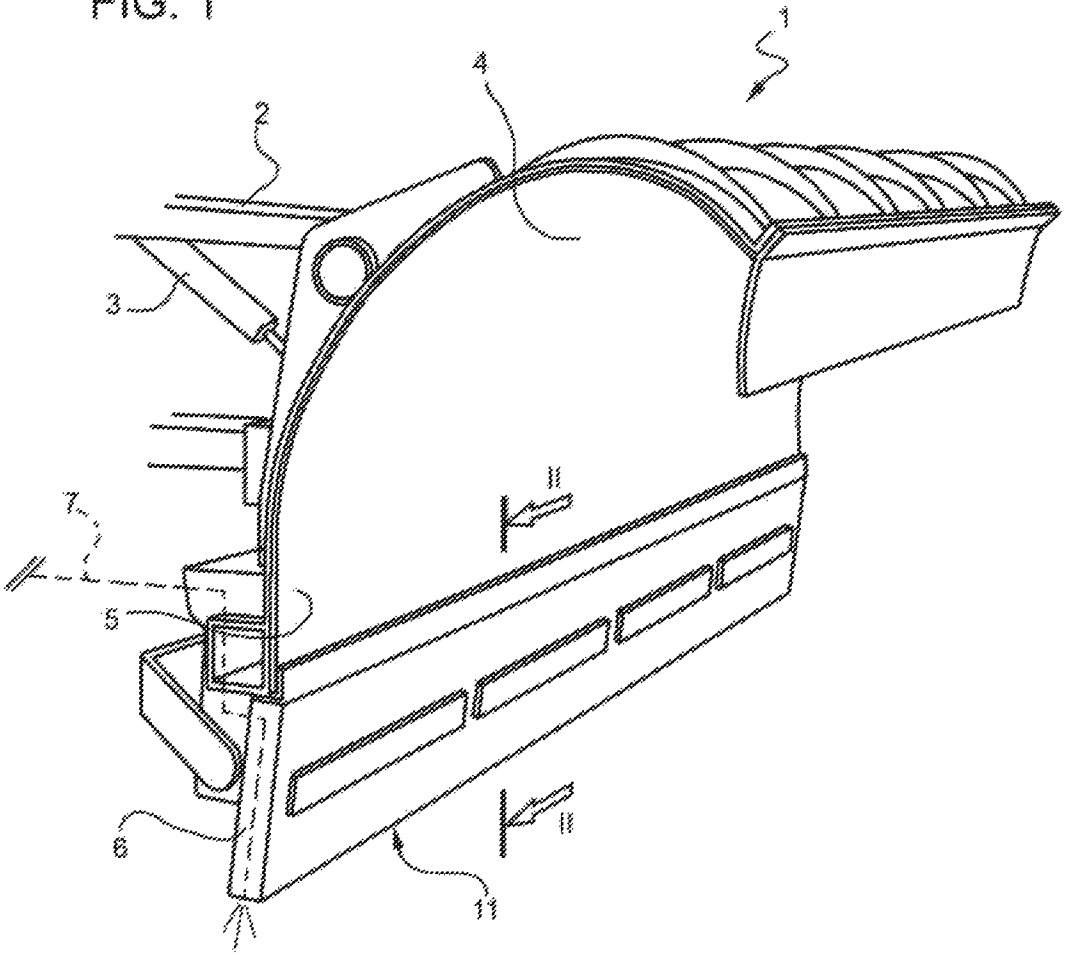
FIG. 1 is a perspective schematic view of an improved blade according to the present invention.
Figure 2:
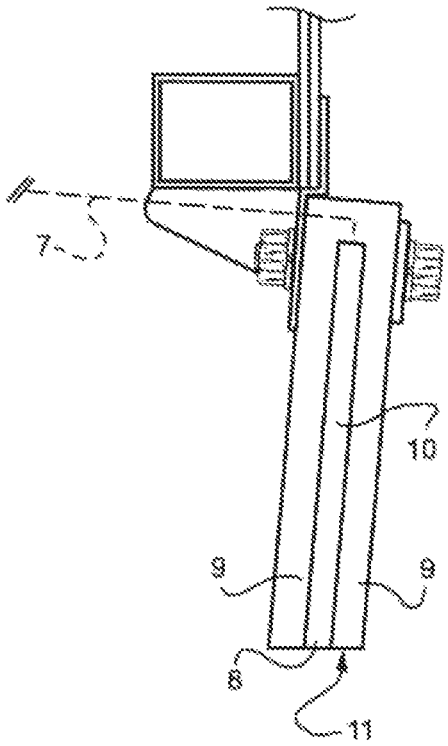
FIG. 2 is a partial cross-section of the blade in FIG. 1 along the line II-II.

As shown in FIGS. 1 and 2 of the Drawings, a blade attachment, generally designated by the reference number 1, can be fitted to a vehicle for removing snow from a road.

The blade 1 is attached to the vehicle by means of a mechanism comprising an articulated arm 2 to guide the movement of the blade 1 at least in the vertical direction and an actuator 3 configured to operate the blade 1 when a driver of the vehicle sends a command from the driver's cab.

The blade 1 comprises a shield 4 having one edge 5 that faces the road, in use, and a cutting edge 6 fixed to the edge 5. The cutting edge 6 is the interface between the road and the shield 4 and is detachably joined to the edge 5 so that it can be replaced when worn out due to coming directly into contact with the road surface.

The blade 1 also comprises a fluid circuit 7 (schematically illustrated in FIG. 1) that is releasably connected to a system on board the vehicle for supplying a de-icing liquid. In particular, the fluid circuit 7 comprises a plurality of delivery ducts attached to the articulated arm 2 and/or to the shield 4 and/or to the cutting edge 6 and a plurality of nozzles 8 connected to the ducts to spread the de-icing liquid on the snow covering the road surface.

According to a preferred embodiment of the present invention, the nozzles 8 are attached to the cutting edge 6 so as to inject the de-icing liquid before or during clearing of the snow by the blade 1 so that the liquid penetrates deep into the layer of snow that remains on the road after the passage of the blade 1. Under ideal conditions, the de-icing liquid penetrates the entire thickness of the snow left on the road surface after the passage of the blade 1.

This effect is achieved, for instance, when the nozzles 8 are incorporated in the thickness of the cutting edge 6. For example the cutting edge 6 comprises a pair of walls 9 facing one another and arranged parallel to the edge 5. The walls 9 define a cavity 10 connected to the ducts through which the de-icing liquid is delivered. The cavity 10 ends towards the road surface with the nozzles 8.

Pursuant to a preferred embodiment, the blade 1 of the present invention works in the following way. The blade 1 is lowered onto the road surface to be cleaned by means of the articulated arm 2 and the actuator 3 so that the cutting edge 6 is as close as possible to the road surface.

The snow collects in the cavity defined by the shield 4 and is deflected over the side edges of the blade 1 onto the side of the road surface. However, a small amount of snow is not deflected and is compressed between the cutting edge 6 and the road surface. In particular, this compression is exerted by the cutting edge 6 due to the effect of the vertical vibrations of the blade 1 and/or due to the effect of the pressure applied to the cutting edge 6 by the snow that is accumulated in the shield 4 and subsequently deflected towards the side of the road surface. This pressure tends to generate an effect similar to the drawing of the snow which passes through the space defined in the vertical direction between the road surface and the cutting edge 6.

The nozzles 8 are configured so as to deposit the de-icing liquid on the remaining snow so that at least a part of the liquid is mixed with the snow beneath the cutting edge 6 during the passage of the latter over the road surface. This effect can be obtained when the nozzles 8 are at least partially defined by the two longitudinal walls 9 of the cutting edge 6.

Various advantages of the blade 1 according to the present invention are described below.

The de-icing liquid is injected into the remaining layer of snow during the formation of the latter, i.e. during the passage of the cutting edge 6, so that the de-icing liquid is spread more effectively through the layer of snow, which thus becomes softer and melts more easily.

When the de-icing liquid is deposited on the layer of snow that remains after the passage of the cutting edge 6, the liquid is not as effective as it is deposited on a more compact surface which prevents the liquid from spreading towards the road surface.

When the nozzle 8 is incorporated in the cutting edge 6, i.e. when the nozzle 8 is either inside the cavity 10 or is at least partially defined by the walls 9, the nozzle is protected and the risk of clogging by debris from the road surface or by some of the deflected snow is extremely low.

Lastly it is clear that modifications and variations may be made to the blade 1 described and illustrated herein without departing from the scope of the present invention, as set forth in the appended claims.

The cavity 10 may be provided with internal channels and dividing walls spaced longitudinally along the edge 5, each channel terminating in a nozzle 8 facing towards the road surface or defining a continuous cavity in a direction parallel to the edge 5. In the latter case, the nozzles 8 may be arranged inside the cavity 10 so as to distribute the de-icing liquid in a substantially uniform manner along said edge 5. The liquid runs due to the effect of gravity down the walls 9 onto the layer of snow that remains following the passage of the blade 1.

Alternatively, the liquid may be pressurized and distributed through the nozzles 8 by means of a specific device for pressurizing the de-icing liquid.

Alternatively, the nozzles 8 may be attached to the cutting edge 6 so as to deliver the de-icing liquid to an area in front of the cutting edge 6. In this way the liquid is always applied to the snow so as to penetrate the remaining layer before the passage of the blade 1. In particular, the snow is mixed with the de-icing liquid before being pressed onto the road surface by the cutting edge 6 or while being compressed and thus penetrates at least before the snow is definitively compressed by the passage of the cutting edge 6 so as to be spread through the entire thickness of the remaining layer of snow.

The cutting edge 6 may be made of a flexible material, for instance an elastomer such as natural rubber, or of a rigid material, i.e. plastic or metal or a metal matrix composite.

Moreover, the cutting edge 6 may have either a positive or negative inclination. A positive inclination is defined when a lower edge 11 proximal to the road surface is in front of the edge 5 of the shield 4 with respect to the direction of travel of the vehicle.

The composition of the de-icing liquid may vary. In particular, it may also comprise a granular component. Moreover, the blade 1 may comprise a second cutting edge preferably made of metal and hinged to the shield 4. The second cutting edge is movable, for example by means of a servo control, between a first retracted position in which the cutting edge 6 comes into contact with the road surface and an extracted position in which the cutting edge 6 is at a distance from the road surface and the second cutting edge comes in contact with the latter. The second movable cutting edge may bear nozzles for distributing de-icing liquid so that the cutting edge compresses snow mixed with said liquid during the passage thereof. For example the second cutting edge may be produced according to that described and illustrated above, i.e. it may incorporate the nozzles 8.

The foregoing description of the present invention provides illustration and description, but is not intended to be exhaustive or to limit the invention to the precise one disclosed. Modifications and variations are possible consistent with the above teachings or may be acquired from practice of the invention. Thus, it is noted that the scope of the invention is defined by the claims and their equivalents.

The invention claimed is:

1. A blade for removing snow from a road surface, the blade comprising:

a shield oriented over a road surface to deflect snow from said road surface;

at least one cutting edge, said at least one cutting edge being attached to a bottom portion of said shield and adjacent to said road surface when in use; and at least one fluid circuit, said at least one fluid circuit comprising:

a plurality of nozzles, said plurality of nozzles capable of spreading a de-icing liquid onto said snow on said road surface; and a plurality of delivery ducts, said plurality of delivery ducts supplying said de-icing liquid to said plurality of nozzles;

wherein said at least one cutting edge has at least one fluid passageway therethrough, a first end of said at least one fluid passageway connected to at least one of said delivery ducts, and at the other end to at least one of said nozzles;

wherein said plurality of nozzles are positioned and configured to spray said liquid downwards and beneath said at least one cutting edge;

wherein said at least one cutting edge is positioned and configured to compress snow on said road surface mixed with said de-icing liquid during the traversal of said blade over said road surface covered with snow.

2. The blade according to claim 1, wherein said plurality of nozzles are attached to said at least one cutting edge.

3. The blade according to claim 1, wherein said plurality of nozzles are within respective fluid passageways within said at least one cutting edge.

4. The blade according to claim 1, wherein said nozzle is composed of a polymeric material.

5. The blade according to claim 1, wherein said at least one cutting edge is composed of a polymeric material.

6. The blade according to claim 5, wherein said at least one cutting edge is composed of a flexible material.

7. The blade according to claim 6, wherein said flexible material is an elastomer.

8. The blade according to claim 7, wherein said elastomer is natural rubber.

9. The blade according to claim 1, wherein said at least one cutting edge is composed of a rigid material.

10. The blade according to claim 9, wherein rigid material is selected from the group consisting of plastic, metal and a metal matrix composite.

11. The blade according to claim 1, wherein said at least one cutting edge has a positive inclination.

12. The blade according to claim 1, wherein said at least one cutting edge has a negative inclination.

13. A snow removal system, comprising:

a vehicle;

a shield secured to a front portion of said vehicle and oriented over a road surface to deflect snow from said road surface;

at least one cutting edge, said at least one cutting edge being attached to a bottom portion of said shield and adjacent to said road surface when in use; and at least one fluid circuit, said at least one fluid circuit comprising:

a plurality of nozzles, said plurality of nozzles capable of spreading a de-icing liquid onto said snow on said road surface; and a plurality of delivery ducts, said plurality of delivery ducts supplying said de-icing liquid to said plurality of nozzles;

wherein said at least one cutting edge has at least one fluid passageway therethrough, a first end of said at least one fluid passageway connected to at least one of said delivery ducts, and at the other end to at least one of said nozzles;

wherein said plurality of nozzles are positioned and configured to spray said liquid downwards and beneath said at least one cutting edge;

wherein said at least one cutting edge is positioned and configured to compress snow on said road surface mixed with said de-icing liquid during the traversal of said vehicle over said road surface covered with snow.

14. The blade according to claim 13, wherein said plurality of nozzles are attached to said at least one cutting edge.

15. The blade according to claim 13, wherein said plurality of nozzles are within respective fluid passageways within said at least one cutting edge.

16. A method for snow removal, the method comprising:

passing a blade over a road surface, said blade comprising a shield and at least one cutting edge attached thereto to deflect snow away from said road surface;

spraying, by a plurality of nozzles attached to said at least one cutting edge, a de-icing liquid onto undeflected snow downwards and beneath said blade; and compressing said undeflected snow mixed with said de-icing liquid with said at least one cutting edge during passage of said blade over said road surface.

* * * * *